US011175096B2

(12) United States Patent
Cheng et al.

(10) Patent No.: US 11,175,096 B2
(45) Date of Patent: Nov. 16, 2021

(54) STRONG COOLING DIRECT AIR-COOLED CONDENSER RADIATING UNIT AND AIR-COOLED ISLAND

(71) Applicant: NORTH CHINA ELECTRIC POWER UNIVERSITY, Beijing (CN)

(72) Inventors: Youliang Cheng, Hebei (CN); Ning Zhang, Hebei (CN); Weiliang Cheng, Hebei (CN); Zijie Wang, Beijing (CN); Yu Zhou, Hebei (CN); Weihua Li, Hebei (CN)

(73) Assignee: North China Electric Power University, Beijing (CN)

( * ) Notice: Subject to any disclaimer, the term of this patent is extended or adjusted under 35 U.S.C. 154(b) by 284 days.

(21) Appl. No.: 16/463,966

(22) PCT Filed: Aug. 16, 2017

(86) PCT No.: PCT/CN2017/097691
§ 371 (c)(1),
(2) Date: May 24, 2019

(87) PCT Pub. No.: WO2018/126694
PCT Pub. Date: Jul. 12, 2018

(65) Prior Publication Data

US 2020/0271385 A1 Aug. 27, 2020

(30) Foreign Application Priority Data

Jan. 5, 2017 (CN) ..... 201710006117.4

(51) Int. Cl.
*F25B 39/04* (2006.01)
*F04F 5/16* (2006.01)
(Continued)

(52) U.S. Cl.
CPC ..... *F28B 1/06* (2013.01); *F28B 9/00* (2013.01); *F28B 7/00* (2013.01);
(Continued)

(58) Field of Classification Search
CPC ..... F28B 1/06; F28B 9/00; F28B 9/02; F28B 9/04; F25B 39/04; F25B 2339/04;
(Continued)

(56) References Cited

U.S. PATENT DOCUMENTS 1,872,785 A * 8/1932 Modine ..... F28D 1/024 165/125
4,062,401 A * 12/1977 Rudny ..... F01P 3/18 165/125

(Continued)

FOREIGN PATENT DOCUMENTS

CN 102003888 A 4/2011
CN 104296553 A 1/2015

(Continued)

OTHER PUBLICATIONS

International search report of PCT Patent Application No. PCT/CN2017/097691 dated Oct. 25, 2017.

(Continued)

*Primary Examiner* — Frantz F Jules
*Assistant Examiner* — Jason N Thompson

(57) ABSTRACT

A strong cooling direct air-cooled condenser radiating unit and an air-cooled island are provided, comprises a cooling wall, an air supply device and a flow guide device located in the cooling wall. The air supply device comprises a unit air supply channel, an air supply ring, and an air collecting cavity. The air supply ring is located at the lower part of the cooling wall and is an annular body with a cavity. An annular slit outlet is formed in the lower part of the air supply ring. The upper part of the air collecting cavity communicates (Continued)

with the air supply ring. A separating plate is provided in the unit air supply channel and divides the unit air supply channel into upper and lower air flues. The upper air flue communicates with the cavity of the air supply ring. The lower air flue communicates with the air collecting cavity.

19 Claims, 5 Drawing Sheets

(51) Int. Cl.
*F28B 1/06* (2006.01)
*F28B 9/00* (2006.01)
*F28B 7/00* (2006.01)

(52) U.S. Cl.
CPC ..... *F28B 2001/065* (2013.01); *F28F 2210/10* (2013.01); *F28F 2250/08* (2013.01)

(58) Field of Classification Search
CPC ..... F28F 2210/10; F28F 2250/00; F28F 2250/02; F24F 1/14; F28D 2001/0266; F28D 2001/0273; F04F 5/16
USPC ..... 165/124, 125
See application file for complete search history.

(56) References Cited

U.S. PATENT DOCUMENTS 4,321,803 A * 3/1982 Smith ..... F24F 1/06 165/125
4,450,899 A * 5/1984 Jakobsson ..... F28B 1/06 165/279
4,589,512 A * 5/1986 Yamaguchi ..... F28D 1/0471 165/41
2003/0070788 A1* 4/2003 Dierbeck ..... F28D 1/05366 165/41
2014/0367067 A1* 12/2014 Jain ..... E21B 43/017 165/45

FOREIGN PATENT DOCUMENTS

CN 104764344 A * 7/2015
CN 104764344 A 7/2015
CN 105180398 A * 12/2015
CN 205156661 U 4/2016
CN 206440144 U 8/2017
DE 3515441 C2 8/1987
JP 2010169285 A 8/2010

OTHER PUBLICATIONS

First Office Action of Counterpart Chinese Patent Application No. 201710006117.4 dated Dec. 22, 2017.

* cited by examiner

STRONG COOLING DIRECT AIR-COOLED CONDENSER RADIATING UNIT AND AIR-COOLED ISLAND

CROSS-REFERENCE TO RELATED APPLICATIONS

This application claims priority to Chinese Patent Application Serial No. 201710006117.4, filed on Jan. 5, 2017, entitled "POWERFUL COOLING HEAT DISSIPATING UNIT OF DIRECT AIR-COOLING CONDENSER". The entire disclosure of which is incorporated by reference herein.

TECHNICAL FIELD

The disclosure relates to a heat-dissipating cooling device for thermal power industry, in particular to a powerful cooling heat dissipating unit of direct air-cooled condenser (i.e. strong cooling direct air-cooled condenser radiating unit).

BACKGROUND ART

At present, many condensing units in the thermal power industry use air-cooling method, especially those which is built in the rich coal and water shortage areas. Air-cooling has become the main cooling method. The use of air-cooling is an air-cooling island consisting of several air-cooled condenser heat-dissipating units as the main heat-dissipating device for steam exhaust of turbine. The air-cooled condenser heat dissipating unit known by the inventors has a problem that the air flow rate is low.

SUMMARY OF THE INVENTION

It is an object of the present disclosure to provide a powerful cooling heat-dissipating unit of direct air-cooled condenser to improve the low air flow rate existing in heat-dissipating unit of air-cooled condenser.

Another object of the present disclosure is to provide an air-cooling island, which is provided with the above-described powerful cooling heat dissipating unit of direct air-cooled condensers.

Embodiments of the present disclosure are implemented by the following technical solutions:

A powerful cooling heat-dissipating unit of direct air-cooled condenser includes a cooling stave. The cooling stave has a shape of a rotary body with a longitudinal axis, and further includes an air supply device and a diversion device. The diversion device is located inside the cooling stave. The air supply device comprises air supply passage unit, air supply ring and air collection cavity, the air supply ring which located at the lower part of the cooling stave is an annular body of cavity, and the annular slit air outlet is arranged at a lower portion of the air supply ring; The air collection cavity which is shaped like a basin is located at the lower part of the air supply ring, and its upper part is connected with the air supply ring; the air supply passage unit is provided with a partition plate, which divides the air supply passage unit into upper and lower air passage; The upper passage is connected to the cavity of the air supply ring, and the lower passage is connected to the air collection cavity.

The diversion device which is arranged from bottom to top is composed of a circular arc guide surface, a spiral guide surface and a chamfered guide surface. The lower part of the arc guide surface penetrates into the air supply ring. The profile of the spiral guide surface is a round-table shape, and spiral grooves are arranged on the periphery of the round-table shape.

The cooling stave is provided with heat exchange tubes and heat radiating fins. Steam distribution tube is arranged at the top of the cooling stave and condensate recovery tube is arranged at the bottom of the cooling stave. The upper part of the air supply ring is connected with the condensate recovery tube. The top of the chamfered guide surface is closed connected with the steam distribution tube. The top of circular arc guide surface is closed connected with the bottom of the spiral guide surface. The top of the spiral guide surface is closed connected with the bottom of the chamfered guide surface.

The height of the circular arc guide surface is 0.2-0.3 times that of the cooling stave, and the height of the spiral guide surface is 0.4-0.5 times that of the cooling stave.

The cone angle a of the spiral guide surface is 30°-60°, the inclination angle c of the tangent to the axis of the spiral guide surface is 20°-50°, and the cone angle b of the chamfered guide surface is 70°-120°.

The cross section of the air supply ring is a water droplet shape, and the air outlet is provided at the inner wall of the air supply ring.

The center of the diversion device, cooling stave, air supply ring and air collection cavity are collinear.

The shape of the outline of the cooling stave is truncated cone, hyperboloid or arc.

Air supply passage unit is connected to the main air passage, and a fan is provided in the main air passage.

The diversion device which includes the second heat exchange tubes, the second heat radiation fins, a second steam distribution tube and a second condensate recovery tube is in the shape of a rotary body with a longitudinal axis; the second steam distribution tube is located above the second condensate recovery tube, two ends of the multiple second heat exchange tubes are respectively communicate with the second steam distribution tube and the second condensate recovery tube; A plurality of second heat dissipating fins are connected between adjacent of second heat exchange tubes.

The distance between the second heat exchange tubes and the longitudinal axis of the diversion device gradually decreases in the direction of the second steam distribution tube to the second condensate recovery tube, Each second heat exchange tubes are evenly arranged around the longitudinal axis of the diversion device.

The diversion device includes a lower flow guiding portion connected with the second condensate recovery tube; the lower flow guiding portion protrudes downwardly into the air supply ring relative to the second condensate recovery tube, and the convex portion has an arc-shaped outer contour.

Air-cooling Island includes main air passage, fan and any of the above-mentioned powerful cooling direct air-cooled condenser heat-dissipating unit;

The fan is installed in the main air passage, which is connected to the air supply passages of each unit.

The main air passage extends along the spiral trajectory.

The technical solution of the present disclosure has at least the following advantages and beneficial effects:

The embodiments of the present disclosure provide a powerful cooling heat-dissipating unit of direct air-cooled condenser. The partition partitions the inside of the air supply passage unit into upper and lower air passages, so that a part of the air in the passage enters the air collection cavity, the other part enters the air supply ring and is blown out by the air outlet at a high speed. The high-speed air blown out by the air outlet drives the air in the air collection cavity upward to the cooling stave, which increases the flow rate of the air blown to the cooling stave, improves the utilization rate of the air and the heat dissipation efficiency.

The heat dissipation efficiency of the air-cooling island provided by the embodiments of the disclosure is also improved because of the powerful cooling direct air-cooled condenser heat-dissipating unit. In addition, the flow rate of the air blown to the cooling stave is increased during the working process due to the powerful cooling direct air-cooled condenser heat-dissipating unit. This also reduces the need for performance, quantity and power consumption of the fans in the main air passage. Compared with the air-cooling island known to the inventor, the air-cooling island provided by the embodiments of the present disclosure can achieve higher cooling efficiency without improving performance, number and power consumption of the fan.

BRIEF DESCRIPTION OF DRAWINGS

In order to make a clearer description of the technical proposal of the embodiments of the disclosure, a brief introduction is given to the accompanying figures that need to be used in the embodiments. It should be understood that the following figures show only certain embodiments of the disclosure and should not be regarded as limiting the scope of the disclosure. For those skilled in the art, other figures can be obtained from these figures without any creative effort.

In the figures: 010—Powerful cooling heat-dissipating unit of direct air-cooled condenser; 020—Powerful cooling heat-dissipating unit of direct air-cooled condenser; 030—air-Cooling island; 100—Cooling stave; 100*a*—Cooling space; 110—First heat exchange tubes; 120—First heat dissipation fins; 130—First steam distribution tube; 140—First condensate recovery tube; 200—Diversion device; 210—Circular arc diversion surface; 220—Spiral diversion surface; 220*a*—Diversion slot; 230—Inverted round platform diversion surface; 300—Air supply device; 310—Air supply ring; 310*a*—First air inlet space; 310*b*—Second air inlet space; 310*c*—Air outlet; 311—First toroid; 312—Second toroid; 313—Third toroid; 320—Air collection cavity; 320*a*—Air collection space; 321—Bottom plate; 322—Board; 330—Air passage unit; 330*a*—Upper air passage; 330*b*—Lower air passage; 331—Partition; 400—Main air passage; 410—Fan; 500—Diversion device; 510—Second heat exchange tubes; 520—Second heat dissipation fins; 530—Second steam distribution tube; 540—Second condensate recovery tube; 550—Downstream diversion section.

DETAILED DESCRIPTION OF EMBODIMENTS

In order to make the purpose, the technical scheme and the advantages of the embodiments of the disclosure more clear, a clear and complete description of the technical scheme in the embodiments of the disclosure will be made in conjunction with the accompanying figures. Obviously, the described embodiments are part of the embodiments of the disclosure, and not all of the embodiments.

Therefore, the following detailed description of the embodiments of the disclosure is not intended to limit the scope of the disclosure that is required to be protected, but only to represent some of the embodiments of the disclosure. Based on the embodiments of the disclosure, all other embodiments obtained by ordinary technicians in the art without creative labor are the scope of the protection of the disclosure.

It needs to be explained that in the case of no conflict, the embodiments and features and technical schemes in the embodiments of the disclosure can be combined with each other.

It should be noted that similar labels and letters represent similar items in the following figures, therefore, once an item is defined in a figure, it does not need to be further defined and interpreted in the subsequent appended figures.

In the description of the disclosure, it should be noted that that the term "first", "second", etc. are used only to distinguish the description, and are not to be construed as indicating or implying relative importance.

Example 1

Figure 1:
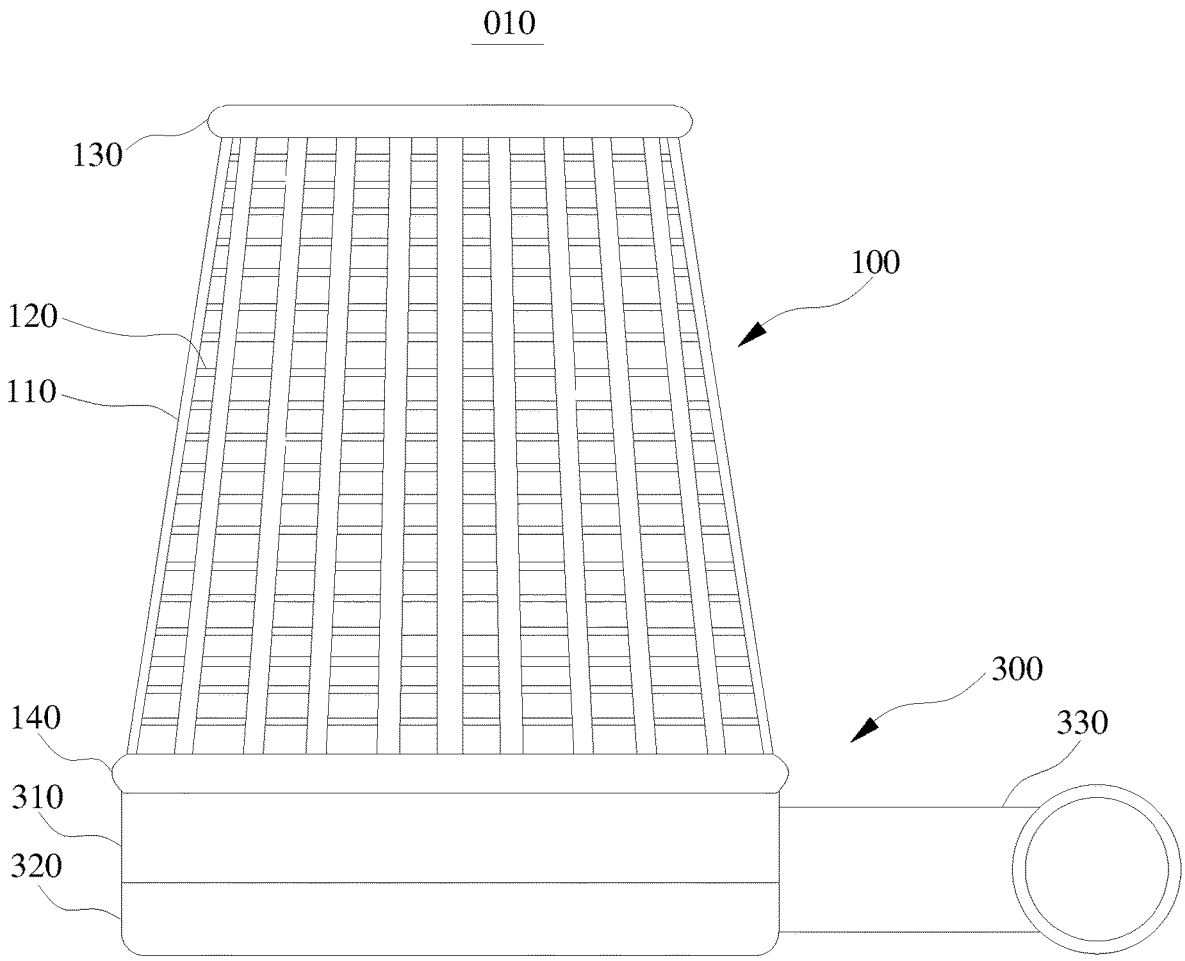
FIG. 1 is a schematic diagram of the external structure of the powerful cooling heat-dissipating unit of direct air-cooled condenser provided by embodiments 1 of the disclosure.
Figure 2:
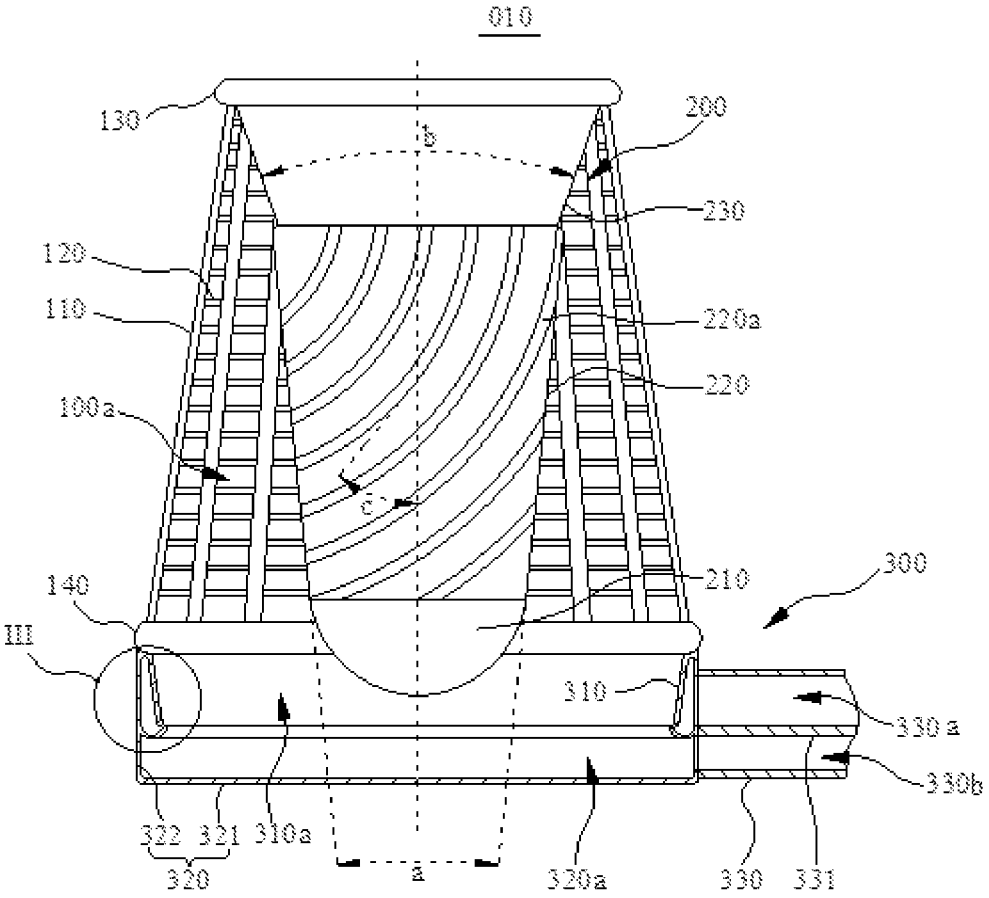
FIG. 2 is a schematic diagram of the internal structure of the powerful cooling heat-dissipating unit of direct air-cooled condenser provided by example 1 of the disclosure.

Refer to FIGS. 1 and 2, FIG. 1 is a schematic diagram of the external structure of powerful cooling heat-dissipating unit of direct air-cooled condenser 010 provided by embodiment of this example, and FIG. 2 is a schematic diagram of the internal structure of powerful cooling heat-dissipating unit of direct air-cooled condenser 010 provided by embodiment of this example. It can be seen from FIGS. 1 and 2 that the powerful cooling heat-dissipating unit of direct air-cooled condenser 010 includes cooling stave 100 and air supply device 300.

Continue with reference to FIGS. 1 and 2, the shape of the cooling stave 100 which defines a cooling space 100*a* is a revolving body with a longitudinal axis. In this embodiment, the cooling stave 100 is a circular form gradually increasing from top to bottom. It can be understood that in other embodiments, the cooling stave 100 can also be hyperboloid or arc-shaped (the bus bar is an arcs). In this embodiment, the cooling stave 100 includes the first heat exchange tubes 110, a first steam distribution tube 130 and a first condensate recovery tube 140. The first steam distribution tube 130 and the first condensate recovery tube 140 are all circular. The first steam distribution tube 130 is coaxial with the first condensate recovery tube 140. The outer diameter of the first steam distribution tube 130 is smaller than the outer diameter of the first condensate recovery tube 140. The first steam distribution tube 130 is located above the first condensate recovery pipe 140. A plurality of first heat exchange tubes 110 are evenly arranged around the axis of the first steam distribution tube 130, one end of the first heat exchange tubes 110 are connected with the first steam distribution tube 130, and the other end of the first heat exchange tubes 110 are connected with the first condensing water recovery tube 140. The steam is fed into the first steam distribution tube 130 and then flows along the first heat exchange tubes 110. Steam flows through the first heat exchange tubes 110 and generates heat exchange with the external air through the first heat exchange tubes 110 to condense the steam. Condensate is discharged after entering the first condensate recovery tube 140. In order to improve the cooling efficiency of the cooling stave 100, the cooling stave 100 also includes the first heat dissipation fins 120 in this embodiment. A plurality of first heat dissipation fins 120 are arranged between the adjacent first heat exchange tubes 110. Both ends of the first heat dissipation fins 120 are respectively connected with the two adjacent first heat exchange tubes 110. Through the first heat dissipation fins 120, the cooling area of the cooling stave 100 can be increased, thereby improving the cooling efficiency of the steam in the first heat exchange tubes 110.

Figure 3:
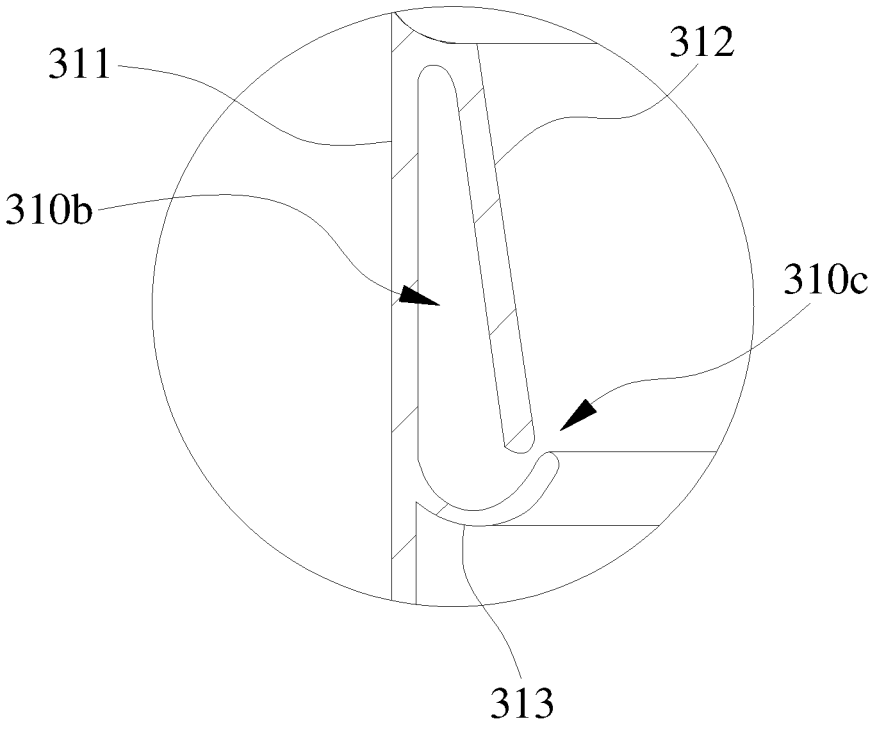
FIG. 3 is an enlarged view of the portion III of FIG. 2.

Continue with reference to FIGS. 1 and 2. In this embodiment, the air supply device 300 includes an air supply ring 310, an air collection cavity 320 and an air supply passage unit 330. The air supply ring 310 is annular, and the inner circumference of the air supply ring 310 defense the first air intake space 310*a*. The air supply ring 310 is positioned below the first condensate recovery tube 140 and connected with the first condensate recovery tube 140. Combined with reference to FIG. 3, FIG. 3 is an enlarged view of the portion III of FIG. 2, showing the cross-section structure of the air supply ring 310. The cross section of the air supply ring 310 includes a first toroid 311, a second toroid 312 and a third toroid 313. The first toroid 311, second toroid 312 and third toroid 313 together form a circular second inlet space 310*b*. The first toroid 311 is located at the 312 outer side of the second toroid, the upper end of the first toroid 311 and the second toroid 312 is connected to each other, and the outer periphery of the third toroid 313 is connected to the lower end of the first toroid 311. The inner circumference of the third toroid 313 and the second toroid 312 are spaced apart to form an annular slot air outlet 310*c*. The second air inlet space 310*b* is connected with the first air inlet space 310*a* through the outlet 310*c*. The air collection cavity 320 includes a floor 321 and an annular cove 322 extending along the edge of the bottom 321. The floor 321 and the panel 322 jointly define the upper open air collection space 320*a*. The upper end of the 322 panel is connected with the lower end of the first toroid 311, so that the air collection space 320*a* is connected with the first air inlet space 310*a*. A baffle 331 is arranged in the air supply passage unit 330, and the partition plate 331 divides the air passage unit 330 into the upper and lower two air passages, which are the upper air passage 330*a* and the lower air passage 330*b*. The upper air passage 330*a* is connected with the second inlet space 310*b*, and the lower air passage 330*b* is connected with the wind collection space 320*a*. In this way, the air in the air passage unit 330 enters the air collection space 320*a* through the lower air passage and the other part enters the second air inlet space 310*b* through the upper air passage 330*a* and is blown out by the air outlet 310*c* at a high speed, and enters the first air inlet space 310*a*. The high speed air in the first intake space 310*a* drives the air in the collection space 320*a* to flow into the cooling space 100*a* at high speed. In this way, the velocity of the air blown to the cooling stave 100 is increased. In addition, when the high speed air in the first air inlet space 310*a* drives the air in the air collection space 320*a* to flow into the cooling space 100*a* at a high speed, a partial negative pressure is generated in the air collection space 320*a*, so that more air in the lower air passage 330*b* is entered into the air collection space 320*a* to balance the air pressure, and then the amount of air entering the cooling space 100*a* is increased, improving the cooling efficiency.

Further, continue with reference to FIG. 3, in this embodiment, the distance between the second toroid 312 and the first toroid 311 is gradually increased along the axis direction of the air supply ring 310, and the inner circumference of the third toroid 313 along the radial direction of the air feeding ring 310 is located inside the 312 lower end of the second toroid, and the third toroid 313 shows a downward protruding arc. In this way, the air entering the second air inlet space 310*b* can be blown from the bottom up to the third toroid 313 at high speed, and then blown upward by the air outlet 310*c* at high speed under the reflection of the third toroid 313, thereby driving the air in the collection space 320*a* flows into the cooling space 100*a* at a high speed, so that the air can efficiently enter the cooling space 100*a*, reducing the power loss in the air flow, further improving the air utilization rate and heat dissipation efficiency.

Please continue to refer to FIG. 2, in order to enable air entering the first air inlet space 310*a* to be blown to various parts of the cooling stave 100, in this embodiment, the powerful cooling heat-dissipating unit of direct air-cooled condenser 010 also includes a diversion device 200, which is set in the first air inlet space 310*a*. The diversion device 200 is used for guiding the air, so that the air can be blown to various parts of the cooling stave 100. Further, the diversion device 200 in this embodiment adopts the following structure. The diversion device 200 generally assumes the shape of an inverted round platform (the diameter of the diversion device 200 is generally decreasing from top to bottom). In this way, the air entering the cooling space 100*a* can be diffused outwards and obliquely upwards in the radial direction under the guidance of the outer peripheral surface of the diversion device 200, thus the air entering the first air inlet space 310*a* can be blown to the various parts of the cooling stave 100. In the flow of air to the bottom, the air flow velocity is gradually increased, and the diversion device 200 is generally in the shape of the inverted round platform, making the distance between the cooling stave 100 and the diversion device 200 gradually decreasing along the direction of the downward. the lower air will flow for a long distance to reach the cooling stave 100, and the upper air only needs a short distance to reach the cooling stave 100, which makes the air flow rate to the various parts of the cooling stave 100 substantially the same, thereby the uniform heat dissipation of various parts of the cooling stave 100 is realized, and the air flow field and the temperature field is more reasonable. In this embodiment, the upper end of the diversion device 200 is connected with the first steam distribution tube 130 to prevent air outflow from the upper end of the cooling stave 100, so that more air can be used for heat dissipation to the cooling stave 100, and the utilization rate of the air is increased.

Please continue to refer to FIG. 2. In this embodiment, the outer surface of the diversion device 200 includes a circular arc guide surface 210, a spiral guide surface 220, and a chamfering stage guide surface 230 arranged in sequence from bottom to top. The circular arc guide surface 210 is an arc surface that is convex downward from the lower end of the diversion device 200 (corresponding to the circular arc guide surface 210 is a water drop shape). The circular arc guide surface 210 penetrates into the first air inlet space 310*a*. In this way, the air flows to the cooling space 100*a* is diverted by the circular arc guide surface 210 so that a part of the air flows directly to the lower portion of the cooling stave 100, and the other portion goes up along the spiral guide surface 220. On the one hand, the air flow resistance is reduced, on the other hand, part of the air can be directed to the lower portion of the cooling stave 100, and the cooling efficiency of the lower portion of the stave 100 is increased. The spiral guide surface 220 is provided with spiral guide grooves 220*a*. Part of the air is blown toward the middle and upper middle portions of the stave 100 in the tangential direction of the guide grooves 220*a* under the guidance of the guide grooves 220*a*, and thus the middle and upper parts of the cooling stave 100 is cooled effectively. The rest of the air continues to ascend and flows toward the upper portion of the cooling stave 100 under the effect of the chamfering stage guide surface 230, so that the upper middle portion of the cooling stave 100 is cooled effectively. In this way, air is sufficiently blown to each part of the cooling stave 100 to maximize the use of air for heat dissipation.

Please continue to refer to FIG. 2. In order to make the distribution of air flow field and temperature field more reasonable, in this embodiment, the height of the circular arc guide surface 210 is 0.2-0.3 times the height of the cooling stave 100, and the height of the spiral guide surface 220 is 0.4-0.5 times the height of the cooling stave 100. The conical angle a of the spiral guide surface 220 is 30°-60°, the inclination c of the tangent of the guide grooves 220*a* with respect to the axis of the diversion device 200 is 20-50°, and the conical angle b of the chamfering stage guide surface is 70-120°.

Please continue to refer to FIG. 2. In this embodiment, the cooling stave 100, the airflow guide device 200, the air supply ring 310 and the air collection cavity 320 are coaxial in order to further improve the uniformity of heat dissipation.

Example 2

Figure 4:
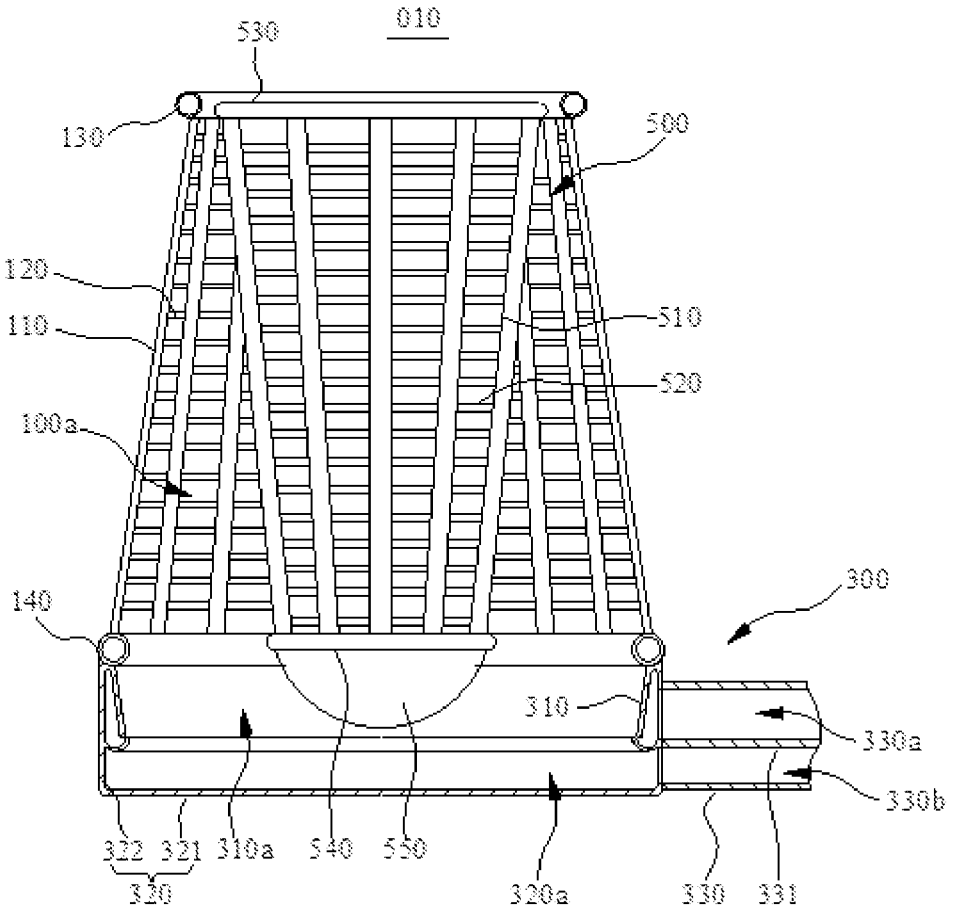
FIG. 4 is a schematic diagram of the internal structure of the powerful cooling heat-dissipating unit of direct air-cooled condenser by example 2 of the disclosure.

Please refer to FIG. 4. According to this embodiment, FIG. 4 is a schematic diagram of the internal structure of the powerful cooling heat dissipating unit of direct air-cooled condensers 010. This embodiment is basically the same as embodiment 1, except that different diversion devices are used. In this embodiment, the diversion device 500 includes the second heat exchange tubes 510, a second steam distribution tube 530 and a second condensate recovery tube 540. The diversion device 500 generally assumes the shape of an inverted round platform (the diameter of the diversion device 500 is generally decreasing from top to bottom). The second steam distribution tube 530 is located above the second condensate recovery tube 540. The second steam distribution tube 530 is disposed coaxially with the second condensate recovery tube 540. Outer diameter of the second steam distribution tube 530 is greater than the outer diameter of the second condensate recovery pipe 540. A plurality of second heat exchange tubes 510 are evenly arranged around the axis of the second steam distribution tube 530, one end of the second heat exchange tubes 510 are communicated with the second steam distribution tube 530, and the other end of the second heat exchange tubes 510 are communicated with the second condensate recovery tube 540. Steam is sent to the second steam distribution tube 530 and then flows along the second heat exchange tubes 510. During the flow of the steam along the second heat exchange tubes 510, heat is exchanged with the outside air through the second heat exchange tubes 510, and steam is cooled. The condensed water obtained by condensation enters the second condensate recovery tube 540 and is discharged. The diversion device 500 acts as a guide for the air so that air can be blown to various parts of the cooling stave 100. The diversion device 500 also cools the steam in the air guiding device 500 during the air guiding process. In this way, the existence of the diversion device 500 greatly improves the heat dissipation area of the powerful cooling heat-dissipating unit of direct air-cooled condenser 010, thereby greatly improving the efficiency of heat dissipation.

Please refer to FIG. 4. In this embodiment, in order to further improve the efficiency of heat dissipation, the diversion device 500 also includes the second heat dissipation fins 520. A plurality of second heat dissipation fins 520 are disposed between the adjacent second heat exchange tubes 510. Both ends of the second heat dissipation fins 520 are respectively connected to the adjacent two second heat exchange tubes 510. With the second heat dissipation fins 520, the heat radiation area of the diversion device 500 can be increased, and the cooling efficiency of the steam in the second heat exchange tubes 510 can be improved.

Please continue to refer to FIG. 4. In this embodiment, the diversion device 500 also includes a lower flow guide portion 550 connected with the second condensed water recovery tube 540. The lower flow guide portion 550 protrudes downward relative to the second condensate recovery tube 540 into the first air inlet space 310*a*. The convex portion has an arcuate outer contour. In this way, the air flowing into the cooling space 100 a is guided by the lower air guide portion 550 so that some air flows directly to the lower portion of the cooling stave 100 and the other goes upward. In this way, on the one hand, the air flow resistance is reduced. On the other hand, part of the air can be directed to the lower part of the stave 100 and the cooling efficiency of the lower part of the stave 100 is increased.

Example 3

Figure 5:
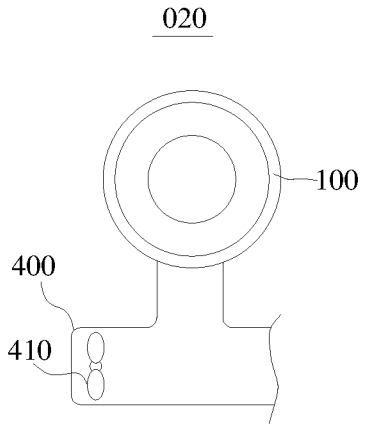
FIG. 5 is a schematic diagram of the powerful cooling heat-dissipating unit of direct air-cooled condenser provided by the example 3 of the disclosure.

Referring to FIG. 5, this embodiment provides a powerful cooling heat-dissipating unit of direct air-cooled condenser 020. The powerful cooling heat-dissipating unit of direct air-cooled condenser 020 also includes a main air passage 400 and a fan 410 provided in the main air passage 400 based on the first and second embodiments. The main air passage 400 communicates with the air supply passage unit 330. The fan 410 operates to introduce external air into the air supply passage unit 330 through the main air passage 400. Because the rate of air utilization and heat dissipation efficiency of the powerful cooling heat-dissipating unit of direct air-cooled condenser 020 provided in this embodiment is high, so the higher cooling efficiency can be obtained and achieve energy conservation effect without increasing the performance, the number and power consumption of fan 410.

Example 4

Figure 6:
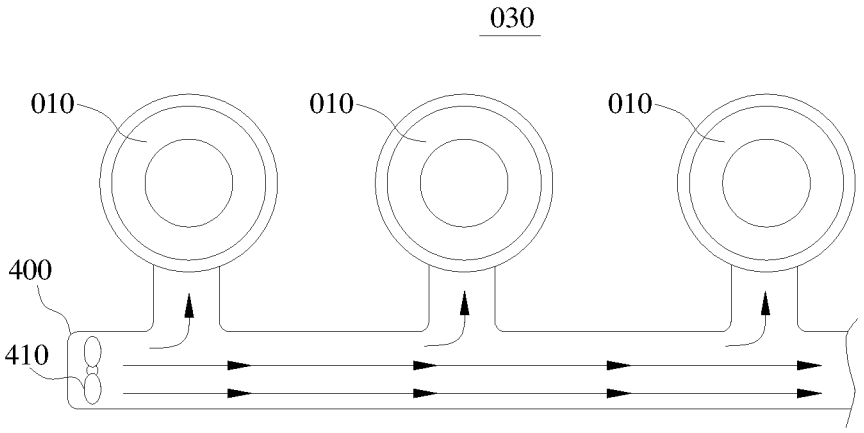
FIG. 6 is a schematic diagram of the air-cooling island provided by example 4 of the disclosure.

Please refer to FIG. 6. In this embodiment, an air-cooling island 030 is provided. The air-cooling island 030 includes a plurality of powerful cooling heat-dissipating unit of direct air-cooled condenser 010 described in Embodiment 1 or Embodiment 2, and also includes a main air passage 400 and a fan 410 provided in the main air passage 400. Each of the air supply passages unit 330 communicates with the main air passage 400. Because the rate of air utilization and heat dissipation efficiency of the powerful cooling heat-dissipating unit of direct air-cooled condenser 010 is high. So the higher cooling efficiency can be obtained and achieve energy conservation effect without increasing the performance, the number and power consumption of fan 410.

In this embodiment, the main air passage 400 may also extend along a spiral trajectory, so that under the condition of having the same number of powerful cooling heat-dissipating unit of direct air-cooled condenser 010, the air-cooling island 030 has a more concentrated footprint, which is convenient for the arrangement of air-cooling island 030.

Obviously, the above-described embodiments of the present disclosure are merely illustrative of the examples of the present disclosure and are not intended to limit the embodiments of the present disclosure. For those of one skill in the art, other variations or changes may be made on the basis of the above description. There is no need and no way to enumerate all embodiments. Any modifications, equivalent substitutions and improvements made within the spirit and scope of the disclosure are intended to be included within the scope of the appended claims.

INDUSTRIAL APPLICABILITY

Powerful cooling heat dissipating unit of direct air-cooled condenser provided in the embodiments of the present disclosure increases the flow rate of the air blown to the cooling stave, improves the rate of air utilization and improves the efficiency of heat dissipation.

The air-cooling island provided by the embodiments of the present disclosure has the above-mentioned powerful cooling heat dissipating unit of direct air-cooled condenser, so the heat-dissipation efficiency of the air-cooling island is also improved. In addition, the flow rate of air blowing to the stave is increased during operation of the powerful cooling heat dissipating unit of direct air-cooled condenser, thus reducing the performance, the number and power consumption requirements of the fan in the main air passage. Compared with the air-cooling island known to the inventors, the air-cooling island provided by the embodiments of the present disclosure can obtain higher heat-dissipation efficiency without increasing the performance, the number and power consumption of the fan.

The invention claimed is:

1. A heat dissipating unit of a direct air-cooled condenser comprising a cooling stave which is in a shape of a rotary body having a longitudinal axis, wherein the heat dissipating unit of the direct air-cooled condenser further comprises an air supply device and a diversion device, the diversion device is located in the cooling stave, and the air supply device comprises an air supply passage unit, an air supply ring and an air collection cavity, wherein the air supply ring is located at a lower part of the cooling stave, the air supply ring is an annular body with a cavity, and a ring-shaped slit air outlet is provided at a lower part of the air supply ring; the air collection cavity is located below the air supply ring, and the air collection cavity is in a shape of a basin, an upper part of the air collection cavity communicates with the air supply ring; a partition plate is disposed in the air supply passage unit; and the partition plate divides the air supply passage unit into upper and lower air passages, the upper air passage communicates with the cavity of the air supply ring, and the lower air passage communicates with the air collection cavity.

2. The heat dissipating unit of a direct air-cooled condenser according to claim 1, wherein the diversion device consists of a circular arc diversion surface, a spiral diversion surface and an inverted round platform diversion surface sequentially arranged in a direction vertical to and away from a first condensate recovery tube, a lower portion of the circular arc diversion surface penetrates into a first air inlet space defined by an inner circumference of the air supply ring, an outline of the spiral diversion surface is in a shape of inverted rounded platform, and spiral grooves are arranged on an outer periphery of the spiral diversion surface.

3. The heat dissipating unit of a direct air-cooled condenser according to claim 2, wherein the cooling stave is provided with first heat exchange tubes and first heat radiation fins, a first steam distribution tube is arranged on a top of the cooling stave, the first condensate recovery tube is arranged at a bottom of the cooling stave, an upper part of the air supply ring is connected to the first condensate recovery tube, a top of the inverted round platform diversion surface is connected to the first steam distribution tube, a top of the circular arc diversion surface is connected to a bottom of the spiral diversion surface, and a top of the spiral diversion surface is connected to a bottom of the inverted round platform diversion surface.

4. The heat dissipating unit of a direct air-cooled condenser according to claim 3, wherein a height of the circular arc diversion surface is 0.2-0.3 times height of the cooling stave, and a height of the spiral diversion surface is 0.4-0.5 times the height of the cooling stave.

5. The heat dissipating unit of a direct air-cooled condenser according to claim 4, wherein a taper angle (a) of the spiral diversion surface is 30°-60°, an inclination angle (c) of a tangent of the spiral grooves to an axis of the spiral diversion surface is 20°-50°, and a taper angle (b) of the inverted round platform diversion surface is 70°-120°.

6. The heat dissipating unit of a direct air-cooled condenser according to claim 5, wherein a cross section of the air supply ring is in a water drop shape, and the ring-shaped slit air outlet is disposed at an inner side wall of the air supply ring.

7. The heat dissipating unit of a direct air-cooled condenser according to claim 6, wherein a center of the diversion device, a center of the cooling stave, a center of the air supply ring and a center of the air collection cavity are collinear.

8. The heat dissipating unit of a direct air-cooled condenser according to claim 7, wherein an outline shape of the cooling stave is round-table shape, double-curve shape or arc shape.

9. The heat dissipating unit of a direct air-cooled condenser according to claim 8, wherein the air supply passage unit communicates with a main air passage, and the main air passage is provided with a fan.

10. The heat dissipating unit of a direct air-cooled condenser according to claim 1, wherein the diversion device is in a shape of a rotary body with a longitudinal axis, the diversion device comprises second heat exchange tubes, second heat radiation fins, a second steam distribution tube and a second condensate recovery tube, the second steam distribution tube is located above the second condensate recovery tube, two ends of a plurality of the second heat exchange tubes are respectively in communication with the second steam distribution tube and the second condensate recovery tube, and a plurality of the second heat dissipation fins are connected between adjacent second heat exchange tubes.

11. The heat dissipating unit of a direct air-cooled condenser according to claim 10, wherein in a direction from the second steam distribution tube to the second condensate recovery tube, a distance between the second heat exchange tubes and a longitudinal axis of the diversion device decreases gradually.

12. The heat dissipating unit of a direct air-cooled condenser according to claim 11, wherein the second heat exchange tubes are evenly arranged around the longitudinal axis of the diversion device.

13. The heat dissipating unit of a direct air-cooled condenser according to claim 12, wherein the diversion device further comprises a lower flow guiding portion connected to the second condensate recovery tube, the lower flow guiding portion protrudes downwards relative to the second condensate recovery tube to enter a first air inlet space defined by an inner circumference of the air supply ring, with a protruding portion having an arcuate outer profile.

14. An air-cooling island, wherein the air-cooling island comprises a main air passage, a fan, and multiple heat dissipating units of a direct air-cooled condenser according to claim 1, the fan is disposed in the main air passage; and each of the air supply passage units communicates with the main air passage.

15. The air-cooling island according to claim 14, wherein the diversion device consists of a circular arc diversion surface, a spiral diversion surface and an inverted round platform diversion surface sequentially arranged in a direction vertical to and away from a first condensate recovery tube, a lower portion of the circular arc diversion surface penetrates into a first air inlet space defined by an inner circumference of the air supply ring, an outline of the spiral diversion surface is in a shape of rounded platform, and spiral grooves are arranged on an outer periphery of the spiral diversion surface.

16. The air-cooling island according to claim 15, wherein the cooling stave is provided with first heat exchange tubes and first heat radiation fins, a first steam distribution tube is arranged on a top of the cooling stave, the first condensate recovery tube is arranged at a bottom of the cooling stave, an upper part of the air supply ring is connected to the first condensate recovery tube, a top of the inverted round platform diversion surface is connected to the first steam distribution tube, a top of the circular arc diversion surface is connected to a bottom of the spiral diversion surface, and a top of the spiral diversion surface is connected to a bottom of the inverted round platform diversion surface.

17. The air-cooling island according to claim 16, wherein a height of the circular arc diversion surface is 0.2-0.3 times height of the cooling stave, and a height of the spiral diversion surface is 0.4-0.5 times the height of the cooling stave.

18. The air-cooling island according to claim 17, wherein a taper angle (a) of the spiral diversion surface is 30°-60°, an inclination angle (c) of a tangent of the spiral grooves to an axis of the spiral diversion surface is 20°-50°, and a taper angle (b) of the inverted round platform diversion surface is 70°-120°.

19. The air-cooling island according to claim 18, wherein a cross section of the air supply ring is in a teardrop shape, and the ring-shaped slit air outlet is disposed at an inner side wall of the air supply ring.

* * * * *